US012704128B2

(12) United States Patent
Czerwonka et al.

(10) Patent No.: US 12,704,128 B2
(45) **Date of Patent: *Aug. 11, 2026**

(54) BLOWER / VAC TOOLS WITH IMPROVED FAN BLADE NOISE

(71) Applicant: Milwaukee Electric Tool Corporation, Brookfield, WI (US)

(72) Inventors: Adam F. Czerwonka, Mukwonago, WI (US); Sourav Sen, Brookfield, WI (US); Nathaniel A. Herrera, Oak Creek, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/910,083

(22) Filed: Oct. 9, 2024

(65) Prior Publication Data

US 2025/0129794 A1 Apr. 24, 2025

Related U.S. Application Data

(60) Provisional application No. 63/592,473, filed on Oct. 23, 2023.

(51) Int. Cl.
*F04D 29/32* (2006.01)
*F04D 19/00* (2006.01)
(Continued)

(52) U.S. Cl.
CPC ..... *F04D 19/002* (2013.01); *F04D 29/325* (2013.01); *F04D 29/522* (2013.01); *F04D 29/664* (2013.01); *F04D 29/666* (2013.01)

(58) Field of Classification Search
CPC .... F04D 19/002; F04D 29/325; F04D 29/522; F04D 29/664; F04D 29/666
See application file for complete search history.

(56) References Cited

U.S. PATENT DOCUMENTS 6,386,830 B1 5/2002 Slipper et al.
2017/0260985 A1 * 9/2017 Gao ..... F04D 25/084
(Continued)

FOREIGN PATENT DOCUMENTS

CN 217810730 U 11/2022
CN 217976712 U 12/2022

OTHER PUBLICATIONS

Engineering Tool Box, Blade Pass Frequency, Jan. 25, 2007 (Year: 2007).*

(Continued)

*Primary Examiner* — Andrew J Marien
(74) *Attorney, Agent, or Firm* — Dority & Manning, P.A.

(57) ABSTRACT

Blower/vacuum tools having reduced fan blade noise are provided. A blower/vacuum tool includes a main body extending between a first end and a second end defining an airflow conduit therethrough; and a fan assembly. The fan assembly includes an axial fan having a number of fan blades ($n_b$), and a motor rotatably connected to the fan. In some embodiments, when ng is in a range from 17-45, the axial fan has a Blade Solidity in a range from $0.0464n_b \leq$Blade Solidity$\leq 0.089n_b$ calculated by the equation Blade Solidity=c/s where c is the length of the chord line of the fan blades, $s=2\pi r_m/n_b$, and $r_m$ is the mean radius of the fan blades. In some embodiments, when the motor operates at a speed of between 21000-38000 rotations per minute (RPM), blade pass frequency (BPF) of the fan assembly as defined by the equation $$BPF = \left(\frac{RPM}{60}\right) * (\#\text{ of blades})$$

is greater than 6 KHz.

10 Claims, 5 Drawing Sheets

(51) Int. Cl.
*F04D 29/52* (2006.01)
*F04D 29/66* (2006.01)

(56) References Cited

U.S. PATENT DOCUMENTS

| | | | | |
|---|---|---|---|---|
| 2020/0096001 | A1* | 3/2020 | Chung | F04D 27/004 |
| 2023/0180906 | A1 | 6/2023 | Yang et al. | |
| 2023/0296102 | A1* | 9/2023 | Herrera | F04D 25/0673 417/411 |
| 2023/0371449 | A1* | 11/2023 | Yu | F04D 29/545 |
| 2025/0092877 | A1* | 3/2025 | Moore | F04D 27/007 |
| 2025/0146494 | A1* | 5/2025 | Tang | F04D 29/388 |
| 2025/0146508 | A1* | 5/2025 | Guo | F04D 29/325 |

OTHER PUBLICATIONS

The Engineering ToolBox, "Blade Pass Frequency—BPF", Dec. 14, 2011 (Year: 2011).*
European Search Report Corresponding to U.S. Appl. No. 24/207,763 on Jun. 10, 2025.
Chinese Office Action Corresponding to Application No. 202422555175 on Jul. 25, 2025.

* cited by examiner

BLOWER / VAC TOOLS WITH IMPROVED FAN BLADE NOISE

CROSS-REFERENCE TO RELATED APPLICATIONS

The present application claims priority to U.S. Provisional patent Application No. 63/592,473 filed on Oct. 23, 2023, the disclosure of which is incorporated by reference herein in its entirety.

FIELD

The present disclosure relates generally to outdoor tools such as blowers, vacuums and/or combined blower/vacuums, and more particularly, to improved fan blade noise in such tools.

BACKGROUND

Outdoor tools such as blowers, vacuums, and combined blower/vacuums (collectively "blower/vac tools") are commonly used to concentrate debris, e.g., leaves, using a blowing function and/or collect debris using a sucking function. Homeowners frequently utilized such blowers to clean their yards and outdoor spaces. Such blower/vac tools being powered by a battery power source are particularly desirable due to their portability. However, improvements in various aspects of blower/vac tools, and particularly hand-held blower/vac tools, are desired.

One issue with known blower/vac tools is the noise level that is generated by the fan assembly, and particularly, the fan blase noise, of the blower/vac tool during operation. The most sensitive range of human hearing is generally between 2-6 KHz due to the alignment of the natural frequency of the ear's auditory canal, while frequencies between 8-12 KHz have significantly lower human hearing sensitivity, and frequencies of 16-20 KHz or greater are inaudible to humans. However, typical fan blade pass frequency for axial fans in leaf blowers is generally between 2.5-4 KHz, which is directly within the most sensitive range of human hearing.

Accordingly, improved blower/vac tools are desired in the art. In particular, a blower/vac tool with reduced fan blade noise would be advantageous.

BRIEF DESCRIPTION

Aspects and advantages of the present disclosure will be set forth in part in the following description, or may be obvious from the description, or may be learned through practice of the technology.

In accordance with one embodiment, a blower/vacuum tool is provided. The blower/vacuum tool includes a main body extending between a first end and a second end defining an airflow conduit therethrough; and a fan assembly. The fan assembly includes an axial fan having a number of fan blades ($n_b$), and a motor rotatably connected to the fan. When $n_b$ is in a range from 17-45, the axial fan has a Blade Solidity in a range from $0.0464n_b \leq$Blade Solidity$\leq 0.089n_b$ calculated by the equation Blade Solidity=c/s where c is the length of the chord line of the fan blades, $s=2\pi r_m/n_b$, and $r_m$ is the mean radius of the fan blades.

In accordance with another embodiment, a blower/vacuum tool is provided. The blower/vacuum tool includes a main body extending between a first end and a second end defining an airflow conduit therethrough; and a fan assembly. The fan assembly includes an axial fan having a number of fan blades ($n_b$), and a motor rotatably connected to the fan. When the motor operates at a speed of between 21000-38000 rotations per minute (RPM), blade pass frequency (BPF) of the fan assembly as defined by the equation $$BPF = \left(\frac{RPM}{60}\right) * (\text{\# of blades})$$

is greater than 6 KHz.

These and other features, aspects and advantages of the present disclosure will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present application, including the best mode of making and using the present systems and methods, directed to one of ordinary skill in the art, is set forth in the specification, which makes reference to the appended figures, in which.

DETAILED DESCRIPTION

Figure 1:
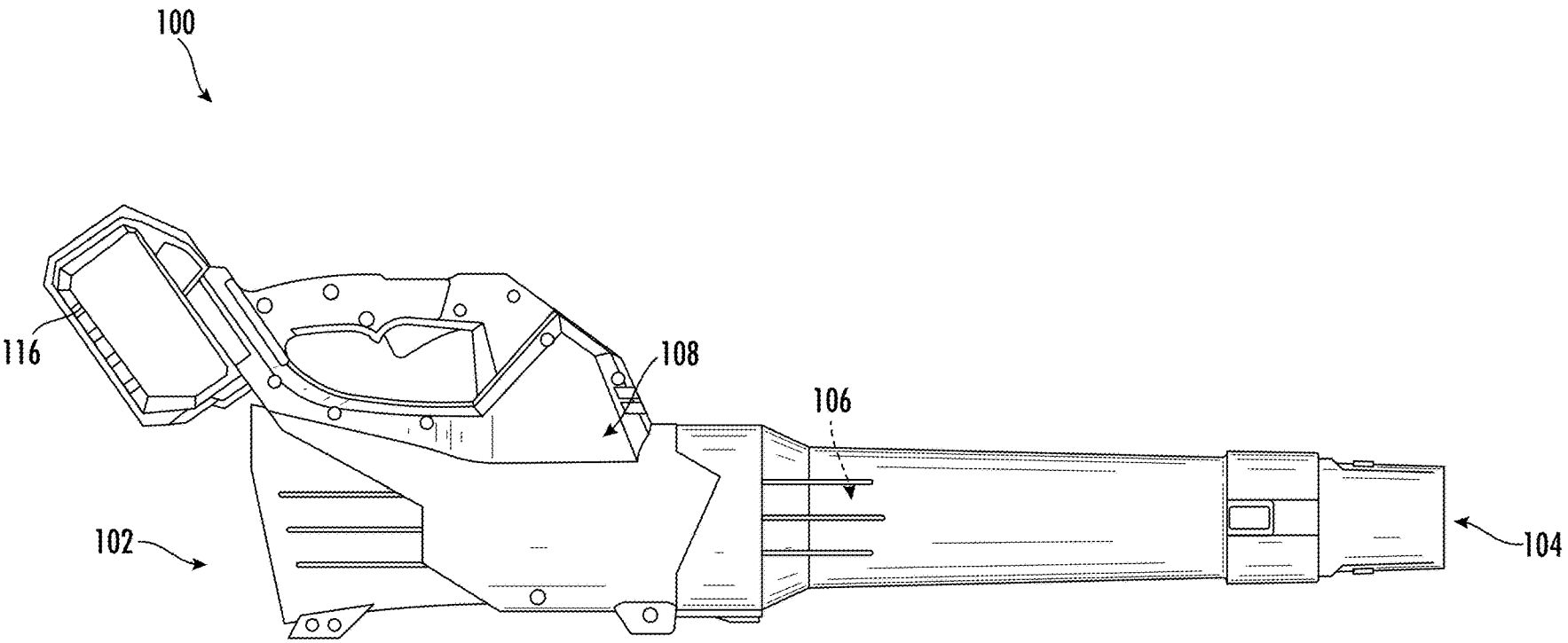
FIG. 1 is a side view of a blower/vacuum tool in accordance with embodiments of the present disclosure.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

In general, the present invention is directed to a blower/vacuum tool having a fan assembly that generated reduced noise during operation. The fan assembly includes an axial fan and a motor. The axial fan, including the number and size of fan blades, and the operational characteristics of the motor, including rotational speed, are optimized to reduce audible noise generated in the sensitive range of human hearing, i.e., about 2-6 KHz, by increasing the blade pass frequency of the fan assembly to frequency greater than 6 KHz.

Referring now to the drawings, FIG. 1 illustrates a side view of a blower/vac tool 100 in accordance with an exemplary embodiment. The blower/vac tool 100 is configured to generate airflow along an airflow conduit 106 extending between a first end 102, e.g., an air inlet, and a second end 104, e.g., an air outlet, of the blower/vac tool 100. The airflow conduit 106 may include a tube as shown.

Figure 2:
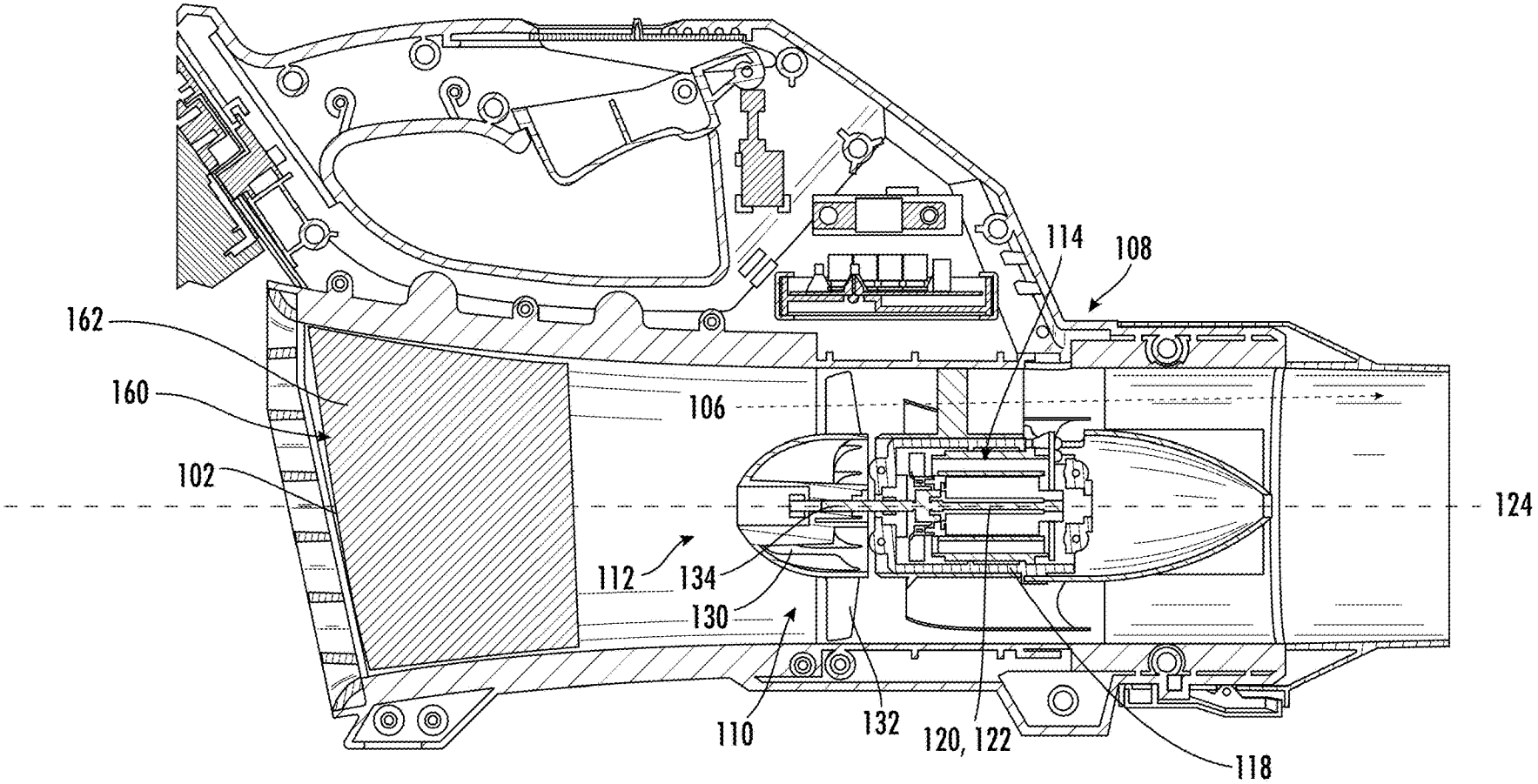
FIG. 2 is a side cross-sectional view of a blower/vacuum tool in accordance with embodiments of the present disclosure.

As illustrated in FIGS. 1 and 2, a housing 108, e.g., a main body of the blower/vac tool 100, may at least partially enclose components of the blower/vac tool 100 such as an airflow generation assembly 110 including a fan 112 and a motor 114 that drives the fan 112, as well as various other components. For instance, airflow generation assembly 110 may be disposed between the first end 102 and the second end 104 of the airflow conduit 106. Power to operate the airflow generation assembly 110 may be provided by a suitable power source such as one or more batteries 116 removably coupled to the housing 108. The blower/vac tool 100 may be provided as a standard handheld blower/vac tool having a cordless battery powered power source. In other embodiments, the blower/vac tool may include a corded electric power source and/or a gas power source. Additionally, a blower/vac tool in accordance with the present disclosure may be a handheld blower/vac tool as shown, or may be provided as a backpack blower/vac tool (not shown) adapted to be worn on a user's back.

In exemplary embodiments, the blower/vac tool may be a blower which utilizes a blowing function, e.g., where airflow is generated from the first end 102 as an inlet to the second end 104 as an outlet. In other exemplary embodiments, the blower/vac tool may be a vacuum which utilizes a sucking function, e.g., where airflow is generated from the second end 104 as an inlet to the first end 102 as an outlet. In other exemplary embodiments, the blower/vac tool may be a combination blower/vacuum which can alternate between utilizing a blowing function and a sucking function.

Still referring to FIGS. 1 and 2, the airflow generation assembly 110 may have an axial configuration including an axial fan 112. The motor 114 may be mounted within the housing 108. For instance, the housing 108 may include a motor mount 118 configured to support the motor 114 between the first end 102 and the second end 104. The motor 114 is oriented along a motor axis 120. The motor axis 120 coincides with a longitudinal axis 124 of the airflow conduit. Rotation of the motor 114 causes rotation of a primary motor shaft 122 extending along the motor axis 120. The motor shaft 122 is coupled to the fan 112, e.g., rotatable connected to the fan 112. In this manner, rotation of the motor shaft 122 causes rotation of the fan 112. The motor 114 may be configured to operate at a rotational speed in a range from about 21000 rotations per minute (RPM) to about 38000 RPM.

The fan 112 includes a hub 130 and a plurality of blades 132. The hub 130 may have a generally circular cross-sectional shape and may extend along the motor axis 120. The motor shaft 122 is coupled to the hub 130 and/or a fan drive shaft 134 to enable transmission of rotation from the motor 114 to the hub 130 or the fan drive shaft 134 and ultimately to the blades 132.

Figure 3:
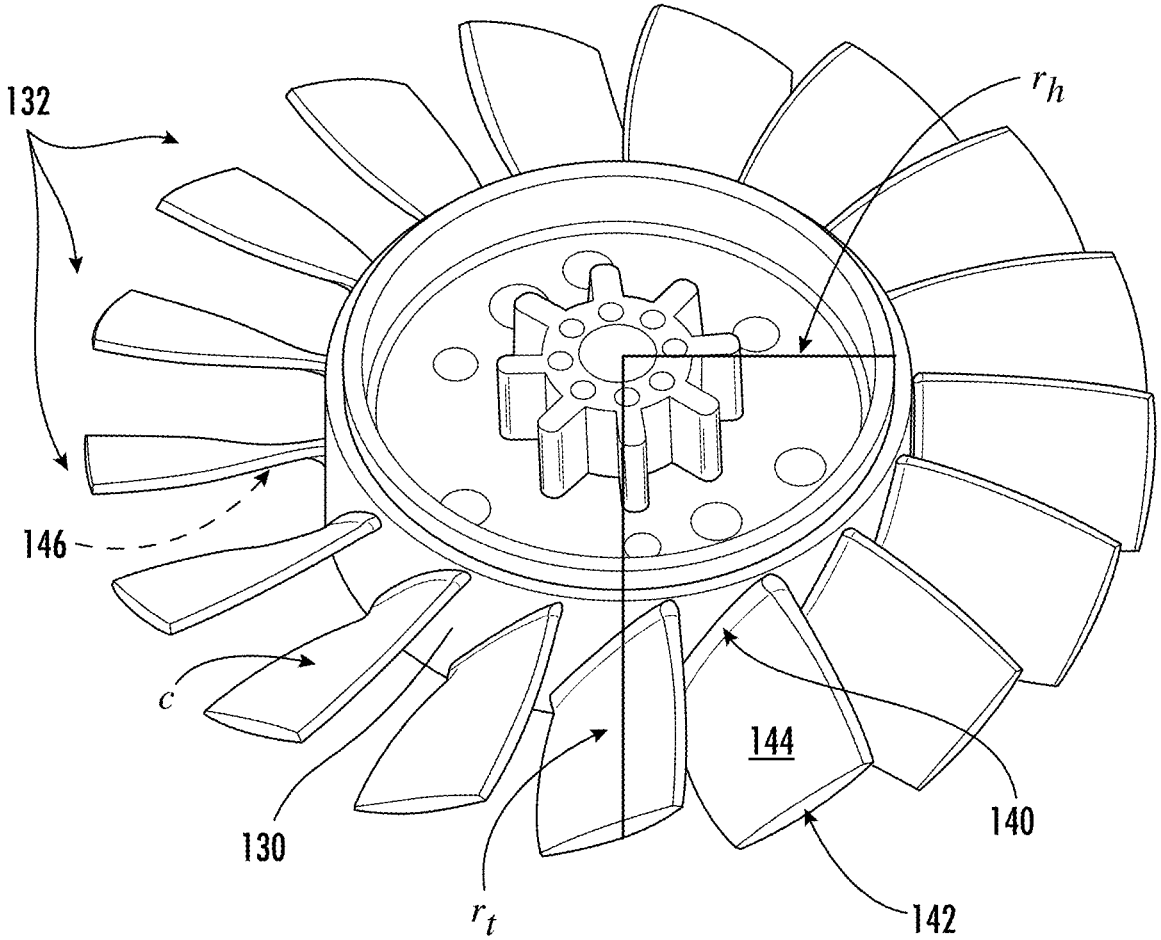
FIG. 3 is a perspective view of an axial fan in accordance with embodiments of the present disclosure.
Figure 4:
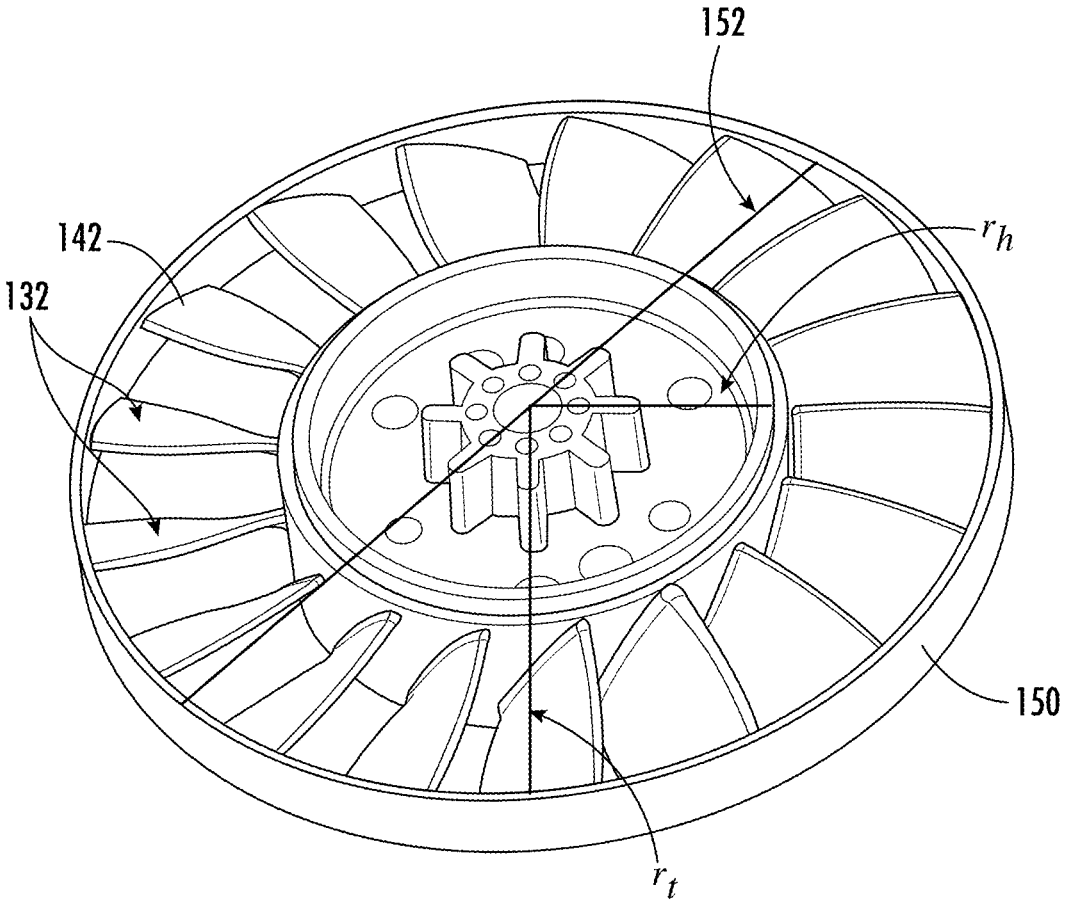
FIG. 4 is a perspective view of an axial fan having an outer ring in accordance with embodiments of the present disclosure.
Figure 5:
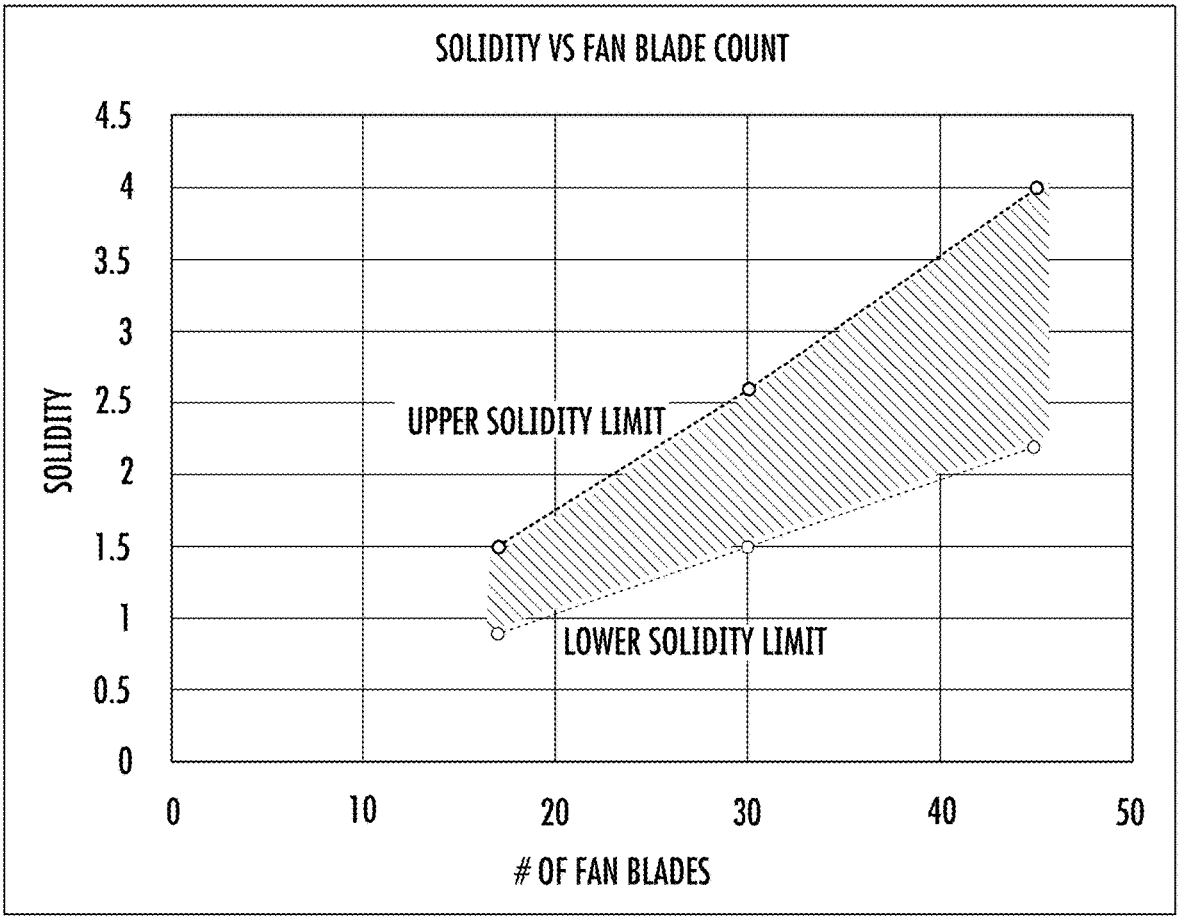
FIG. 5 is a graphical representation of the blade solidity of an axial fan relative to the number of fan blades of the axial fan in accordance with embodiments of the present disclosure.

As best seen in FIGS. 3 and 4, each respective fan blade 132 extends radially away from the hub 130. Each blade 132 extends from a root 140 and terminates at a tip end 142, and has a first face 144 and a second face 146 opposite the first face 144. The root 140 contacts the hub 130 of the fan 112. The tip end 142 contacts the hub 130 at a different angular position around the circumference of the hub 130 than the root 140. In another embodiment (not shown), the tip end 142 may contact an adjacent blade 132 of the fan 112.

As shown in FIG. 3 and FIG. 4, the fan 112 may have an inner radius $r_h$ defined by a radius of the hub 130, and an outer radius $r_t$ defined by a radius of the fan at the tip 142 of the blades. The fan 112 may include any suitable number of fan blades (also referred to herein as $n_b$), as further described below.

FIG. 4 illustrates an embodiment of the fan 112 that may include an outer ring 150 surrounding the fan blades 132. For instance, the outer ring 150 may contact the tip end 142 of one or more of the fan blades 132, e.g., all of the fan blades 132. In this manner, during operation of the blower/vac 10, the outer ring 150 may rotate with rotation of the axial fan 112 and the motor 114.

In some aspects of the invention, e.g., as generally illustrated in FIG. 2, the outer ring 150 may have an inner diameter 152 equal to $2r_t$. The inner diameter 152 may be generally equal to an inner diameter of the first end 102 and/or an inner diameter of the second end 104. For instance, the inner diameter 152 may be generally equal to both an inner diameter of the first end 102 and an inner diameter of the second end 104. Moreover, the longitudinal axis 124 may extend through a center point of the first end 102, a center point of the outer ring 150, and a center point of the second end 104. In this manner, the airflow conduit may have a generally constant diameter along the length of the airflow conduit 106, thereby reducing disruptions to the flow within the airflow conduit.

The present inventors have found that the blade pass frequency of the blower/vac tool 10 may correspond to the sound frequency generated by the axial fan of the tool 10. Blade pass frequency can be calculated using the equation:

$$BPF = \left(\frac{RPM}{60}\right) * (\text{\# of blades}).$$

In this regard, the number of blades, also referred to herein as $n_b$, and the rotational speed of the fan may directly influence the sound frequency generated by the blower/vac 10. As human hearing is most sensitive to sound frequencies between 2-6 KHz, and hearing sensitivity is reduced and/or diminished above 6 KHz, the present inventors have found that achieving a higher blade pass frequency may therefore reduce the audible noise generated by the blower/vac tool 10. Based on the equation provided, the present inventors have found that to achieve a higher blade pass frequency above 6 KHz and therefore reduce audible noise generated, the motor rotational speed may be increased, the number of fan blades 132 may be increased, or both the motor rotational speed and the number of fan blades 132 may be increased.

In the blower/vac 10 of the present invention, as noted above, the motor may be configured to rotate at a rotational speed of between about 21000-38000 RPM. As human hearing is most sensitive to sound frequencies between 2-6 KHz, the present inventors have found that providing a blower/vac 10 having a blade pass frequency of greater than 6 KHz may be desirable. Thus, when the blower/vac 10 may operate at a rotational motor speed as low as 21000 RPM, the present inventors have found that it may be desirable to implement a fan 112 having at least 17 fan blades 132.

Further, it may be desirable to increase the number of fan blades 132 provided on the fan 112. Blade Solidity is measure of fan blade spacing, which is directly influenced by the number of blades provided on a given fan. Blade Solidity is defined by the equation: Blade Solidity=c/s where $s=2\pi r_m/n_b$. In this equation, c is the length of the chord line of the fan blades and $r_m$ is the mean radius of the fan blades. The mean radius of the fan blades $r_m$ is calculated by the equation $$r_m = \left[(r_t^2 + r_h^2)/2\right]^{0.5}.$$

The present inventors have found that increasing the Blade Solidity of the fan 112, by increasing the number of blades, may result in a blower/vac 10 having reduced audible noise generated during operation. Further, as the number of blades $n_b$ increases, the blade solidity value may increase as well. The present inventors have found that ideal noise reduction may be achieved when the fan 112 of the blower/vac 10 satisfies the following conditions: ng is in a range from 17 to 45, the axial fan 112 may have a Blade Solidity in a range from $0.0464n_b \leq$Blade Solidity$\leq 0.089n_b$.

The present inventors have found that the airflow generation assembly 110 of the present invention having an axial fan 112 may be optimized when a dimensionless flow coefficient Φ is in a range from about 0.2 to about 0.6. The size and speed of the airflow generation assembly 110 are defined as a function of the optimal flow coefficient Φ. The flow coefficient is calculated by the following equation:

$$\Phi = \frac{q/(A)}{\omega R}$$

where q represents flow ($m^3/s$), A represents cross sectional area at the fan ($m^2$), ω represents speed (rad/s) and R represents fan tip radius (m) measured at a blade tip 142. Stated differently, the numerator q/(A) is the axial velocity of the fan (meters per second).

Based on the calculation of the flow coefficient Φ as shown above, the optimal size of the fan may be determined by rearranging the equation as shown below:

$$R = \frac{q/(A)}{\omega \Phi_{ideal}}$$

By optimizing both the blade solidity and the flow coefficient of the airflow generation assembly 110 during operation of the blower/vac 10, the present inventors have found that the blower/vac 10 may generate less audible noise while maintaining optimal airflow characteristics, thereby improving the user's overall experience during operation of the blower/vac 10. For instance, reducing the audible noise generated by the blower/vac 10 may be highly desirable to users, particularly for homeowners and other non-professional users. Simultaneously, maintaining optimal airflow characteristics may enable efficient battery life of the blower/vac 10, reducing the need for users to recharge or replace the power source without reducing the power of the airflow generated during operation.

To further reduce the audible noise generated by the blower/vac 10 during operation, the housing 108 may include an inlet muffler 160 disposed at the first end 102. For instance, the inlet muffler 160 may be disposed within the airflow conduit 106 at the first end 102. In some embodiments, the inlet muffler 160 may include a liner 162 surrounding at least a portion of the airflow conduit 106. The liner 162 may comprise noise-absorbing material. In particular, the noise-absorbing material may be configured to absorb noise in a frequency range of 2-6 KHz in order to reduce the audible noise in the human hearing frequency range. The noise-absorbing material may include foam. Additionally or alternatively, the noise-absorbing material may include foam, such as but not limited to foam/film laminates, such as polyurethane foam. The liner 162 may surround an entire circumference of the air conduit 106 and/or may surround one or more portions of the circumference of the air conduit 106.

Further aspects of the present disclosure are provided by one or more of the following embodiments:

A blower/vacuum tool includes a main body extending between a first end and a second end defining an airflow conduit therethrough; and a fan assembly. The fan assembly includes an axial fan having a number of fan blades ($n_b$), and a motor rotatably connected to the fan. When the motor operates at a speed of between 21000-38000 rotations per minute (RPM), blade pass frequency (BPF) of the fan assembly as defined by the equation $$BPF = \left(\frac{RPM}{60}\right) * (\#\text{ of blades})$$

is greater than 6 KHz.

The blower/vac tool of any one or more of the embodiments, wherein the plurality of fan blades comprises from 17 to 45 fan blades.

The blower/vac tool of any one or more of the embodiments, wherein the axial fan comprises a hub and the plurality of fan blades extend from the hub at a root of each respective fan blade.

The blower/vac tool of any one or more of the embodiments, wherein each of the plurality of fan blades terminates at a tip of each respective fan blade, the axial fan further comprising an outer ring in contact with the tip of each respective fan blade.

The blower/vac tool of any one or more of the embodiments, wherein the outer ring rotates with rotation of the axial fan.

The blower/vac tool of any one or more of the embodiments, wherein the outer ring comprises an inner diameter, wherein the inner diameter of the outer ring is generally equal to an inner diameter of the first end and/or an inner diameter of the second end.

The blower/vac tool of any one or more of the embodiments, wherein a longitudinal axis extends through a center point of the first end of the main body, a center point of the outer ring, and a center point of the second end of the main body.

The blower/vac tool of any one or more of the embodiments, further comprising an inlet muffler disposed at the first end of the main body, the inlet muffler including a liner comprising noise-absorbing material configured to absorb noise in a frequency range of 2-6 KHz.

The blower/vac tool of any one or more of the embodiments, wherein the noise-absorbing material comprises foam.

The blower/vac tool of any one or more of the embodiments, wherein when the motor operates at a rotational speed of between 21000-38000 rotations per minute (RPM), the fan assembly has a dimensionless flow coefficient Φ in a range from about 0.3 to 0.5 as calculated by the equation $$\Phi = \frac{q/(A)}{\omega R}$$

where q represents flow ($m^3/s$), A represents cross sectional area at the fan ($m^2$), ω represents speed (rad/s) and R represents fan tip radius (m) measured at a blade tip.

A blower/vacuum tool includes a main body extending between a first end and a second end defining an airflow conduit therethrough; and a fan assembly. The fan assembly includes an axial fan having a number of fan blades ($n_b$), and a motor rotatably connected to the fan. When $n_b$ is in a range from 17-45, the axial fan has a Blade Solidity in a range from $0.0464n_b \leq$Blade Solidity$\leq 0.089$ ng calculated by the equation Blade Solidity=c/s where c is the length of the chord line of the fan blades, $s=2\pi r_m/n_b$, and $r_m$ is the mean radius of the fan blades. The blower/vac tool of any one or more of the embodiments, wherein the axial fan comprises a hub and each of the fan blades extends from the hub at a root of each respective fan blade.

The blower/vac tool of any one or more of the embodiments, wherein each of the fan blades terminates at a tip of each respective fan blade, the axial fan further comprising an outer ring in contact with the tip of each respective fan blade.

The blower/vac tool of any one or more of the embodiments, wherein the outer ring rotates with rotation of the axial fan.

The blower/vac tool of any one or more of the embodiments, wherein the outer ring comprises an inner diameter, wherein the inner diameter of the outer ring is generally equal to an inner diameter of the first end and/or an inner diameter of the second end.

The blower/vac tool of any one or more of the embodiments, wherein a longitudinal axis extends through a center point of the first end of the main body, a center point of the outer ring, and a center point of the second end of the main body.

The blower/vac tool of any one or more of the embodiments, further comprising an inlet muffler disposed at the first end of the main body, the inlet muffler including a liner comprising noise-absorbing material configured to absorb noise in a frequency range of 2-6 KHz.

The blower/vac tool of any one or more of the embodiments, wherein the noise-absorbing material comprises foam.

The blower/vac tool of any one or more of the embodiments, wherein when the motor operates at a rotational speed of between 21000-38000 rotations per minute (RPM), the fan assembly has a dimensionless flow coefficient Φ in a range from about 0.3 to 0.5 as calculated by the equation $$\Phi = \frac{q/(A)}{\omega R}$$

where q represents flow ($m^3/s$), A represents cross sectional area at the fan ($m^2$), ω represents speed (rad/s) and R represents fan tip radius (m) measured at a blade tip.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A blower tool comprising:

a main body defining an airflow conduit therethrough, the main body extending between a first end and a second end; and a fan assembly disposed between the first end and the second end, the fan assembly comprising an axial fan having a plurality of fan blades, and a motor rotatably connected to the fan;

wherein when the motor operates at a rotational speed of between 21000-38000 rotations per minute (RPM), the fan assembly has a dimensionless flow coefficient Φ in a range from about 0.3 to 0.5 as calculated by an equation $$\Phi = \frac{q/(A)}{\omega R}$$

where q represents flow ($m^3/s$), A represents cross sectional area at the axial fan ($m^2$), ω represents speed (rad/s) and R represents fan tip radius (m) measured at a blade tip.

2. The blower tool of claim 1, wherein the plurality of fan blades comprises from 17 to 45 fan blades.

3. The blower tool of claim 1, wherein the axial fan comprises a hub and the plurality of fan blades extend from the hub at a root of each respective fan blade.

4. The blower tool of claim 3, wherein each of the plurality of fan blades terminates at a tip of each respective fan blade, the axial fan further comprising an outer ring in contact with the tip of each respective fan blade.

5. The blower tool of claim 4, wherein the outer ring rotates with rotation of the axial fan.

6. The blower tool of claim 4, wherein the outer ring comprises an inner diameter, wherein the inner diameter of the outer ring is generally equal to an inner diameter of the first end and/or an inner diameter of the second end.

7. The blower tool of claim 4, wherein a longitudinal axis extends through a center point of the first end of the main body, a center point of the outer ring, and a center point of the second end of the main body.

8. The blower tool of claim 1, further comprising an inlet muffler disposed at the first end of the main body, the inlet muffler including a liner comprising noise-absorbing material configured to absorb noise in a frequency range of 2-6 KHz.

9. The blower tool of claim 8, wherein the noise-absorbing material comprises foam.

10. The blower tool of claim 1, wherein when the motor operates at the rotational speed of between 21000-38000 rotations per minute (RPM), blade pass frequency (BPF) of the fan assembly as defined by the equation $$BPF = \left(\frac{RPM}{60}\right) * (\#\text{ of blades})$$

is greater than about 6 KHz.

* * * * *